United States Patent [19]

Sperber

[11] Patent Number: 4,712,347

[45] Date of Patent: Dec. 15, 1987

[54] METHOD AND APPARATUS FOR CONTAINING INSULATION USING NETTING

[76] Inventor: Henry V. Sperber, 8 Red Fox La., Englewood, Colo. 80111

[21] Appl. No.: 925,309

[22] Filed: Oct. 31, 1986

[51] Int. Cl.[4] ..... E04B 1/74

[52] U.S. Cl. ..... 52/404; 52/743

[58] Field of Search ..... 52/404, 743

[56] References Cited

U.S. PATENT DOCUMENTS

| | | | |
|---|---|---|---|
| 1,530,662 | 3/1925 | Gibbons | 52/743 |
| 2,235,542 | 3/1941 | Wenzel | 52/743 |
| 2,318,744 | 5/1943 | Brown | 52/743 |
| 2,989,790 | 6/1961 | Brown | 52/743 |
| 3,619,437 | 11/1971 | McDonald | 52/743 |
| 4,021,972 | 5/1977 | Choate | 52/743 |
| 4,177,618 | 12/1979 | Felter | 52/743 |
| 4,292,777 | 10/1981 | Story . | |
| 4,385,477 | 5/1983 | Walls et al. . | |

FOREIGN PATENT DOCUMENTS

| | | | |
|---|---|---|---|
| 2708733 | 9/1977 | Fed. Rep. of Germany | 52/743 |

*Primary Examiner*—Henry E. Raduazo

*Attorney, Agent, or Firm*—Sheridan, Ross & McIntosh

[57] ABSTRACT

An apparatus and a method to retain loose fill or particulate insulation between the outer and inner walls of a structure is provided. The apparatus comprises netting composed of netting material with some degree of flexibility and is constructed so as to provide a number of netting or air passage holes in which the surface area of the netting material is substantially less than the area or holes defined between the pieces of netting material. The netting is adapted to be secured to the vertically extending studs and horizontally extending joists of the structure. The netting is secured to the inwardly facing sides of the studs and joists after the outer wall has been mounted on the structure. One or more access holes are then created in the netting and a hose is inserted in each access hole to deliver the particulate insulation into the enclosed space defined by the outer walls, the studs, the joists and the netting. During receipt of the particulate insulation by the enclosed space, displaced air exits through the netting holes thereby achieving efficient compaction of the particulate insulation. Additionally, the netting bulges slightly when an appropriate amount of insulation has been received and positioned within the enclosed space.

15 Claims, 4 Drawing Figures

FIG.1

METHOD AND APPARATUS FOR CONTAINING INSULATION USING NETTING

FIELD OF THE INVENTION

The present invention relates to an apparatus and method for retaining loose fill insulation within walls of a structure and, more particularly, to a netting apparatus, secured to inner wall supports of the structure, which allows air to escape during the insertion of insulation.

BACKGROUND OF THE INVENTION

An increasingly preferred method of installing insulation into a building or residential structure is the method of "blowing in" or spraying insulation particles mixed with adhesive into the space between the outer and inner walls of the structure. The aggregate of insulation particles and the adhesive is commonly referred to as loose fill insulation. The outer walls of the structure are typically composed of concrete, masonry, metal or alloy sheeting or wood. The inner walls are typically composed of drywall, paneling or plaster mounted on a backing. The outer walls may be mounted on the same support skeleton which supports the inner walls or they may be mounted on a separate support skeleton.

The construction sequence calls for the outer walls to be installed before the inner walls. Prior to the construction of the inner walls, it is desirable to "blow in" the loose fill insulation so that no access holes need be placed in the inner walls once they are constructed. However, prior placement of the insulation requires the use of some means to retain the insulation between the wall framing until the inner wall can be constructed to act as a retaining barrier.

The patent to Walls et al. (U.S. Pat. No. 4,385,477), discloses a method for attaching heat shrinkable material to the wall framing and then blowing in particulate insulation through selected holes in the heat shrinkable material. However, there are several drawbacks associated with the use of heat shrinkable material. First, the material presents an impermeable barrier which prevents the escape of air which is displaced during the installation of the blown-in particles. It is desirable to allow displaced air to escape during the installation process so as to facilitate uniform compaction of the particles. Secondly, the method calls for covering the entire area between adjacent wall and ceiling supports with the heat shrinkable material. It is desirable to reduce the amount of material required for the installation of insulation particles prior to construction of the inner walls.

The invention disclosed in the patent to Story (U.S. Pat. No. 4,292,777) is directed to a system for supporting blowable insulation installed in a horizontally extending frame. A rectangular cardboard sheet with perpendicularly disposed tabs is positioned between two adjacent joists and attached to the joists. The particulate insulation is sprayed into the space between the cardboard sheet and the finished ceiling or floor. However, the Story invention fails to disclose the use of netting or any method of determining that sufficient insulation material has been blown in so as to achieve a desired density of insulation. The cardboard includes a relatively few number of holes and is more expensive than netting. The cardboard sheet disclosed in the Story patent is also constructed with a fixed width so that adjustments must be made to install the cardboard sheet between joists which are spaced apart at a non-customery width.

SUMMARY OF THE INVENTION

A method and an apparatus are disclosed for retaining loose fill insulation within floor to ceiling spaces formed between the inner and outer walls of a structure. The apparatus of the present invention comprises netting composed of netting material arranged to provide a number of netting holes of substantially equal size. The area of the netting holes is substantially greater than the area of the netting material that defines the netting holes. The netting is adapted to be attached to the vertically extending, spaced studs which typically serve as the mounting frame for the inner walls of a structure. Prior to the mounting of the finished inner wall, the netting apparatus is attached to the inner side of the studs, from floor to ceiling, so as to form a retaining barrier for loose fill insulation which is inserted between the netting and the previously mounted outer walls. The netting apparatus retains the loose fill insulation inserted between the netting and the outer wall.

The present invention also includes a method for retaining loose fill insulation within vertically extending spaces formed between the inner and outer walls of a structure. In accordance with the method of the present invention, the netting apparatus of the present invention is secured to the inwardly facing sides of the spaced studs of the structure. Selected netting holes are widened or the netting material forming the holes is cut to create an opening to receive a hose nozzle for use in delivery of the insulation. Loose fill insulation is delivered by the hose into the space between the netting and the inner surface of the outer wall. As the loose fill insulation is delivered into the space, it compacts together and the numerous netting holes permit the air displaced by the deposited insulation to readily escape. Additionally, the netting is so constructed that it will bow outward when sufficient loose fill insulation has been received in the wall space. Thereafter, the operator can widen another netting hole to continue the delivery of loose fill insulation until the entire extent of the space is filled with insulation.

In the preferred embodiment of the invention, netting is provided having uniformly spaced horizontal rows and vertical columns of netting material. The overlapping rows and columns of netting material form netting holes which permit the passage of air displaced by the loose fill insulation. By appropriately selecting netting material of a certain rigidity and by appropriately sizing the netting holes, the netting is sufficiently rigid to resist bowing or bulging until a proper density of loose fill insulation is deposited between the netting and the outer wall. Conversely, the netting is sufficiently elastic so that it bows or bulges when an adequate quantity of insulation has been deposited.

The present invention provides a number of advantages. The netting apparatus is easily installed and requires no further handling once it is secured to the structure. Material costs are reduced as the netting apparatus requires less material than other insulation retaining apparatuses. Additionally, the neting apparatus of the present invention allows the particulate insulation to compact to a desirable density by allowing displaced air to exit as the insulation is inserted. The netting apparatus provides the further advantage of alerting the insulation installer that an appropriate amount of insulation has been inserted.

DETAILED DESCRIPTION OF THE PREFERRED EMBODIMENT

Figure 1:
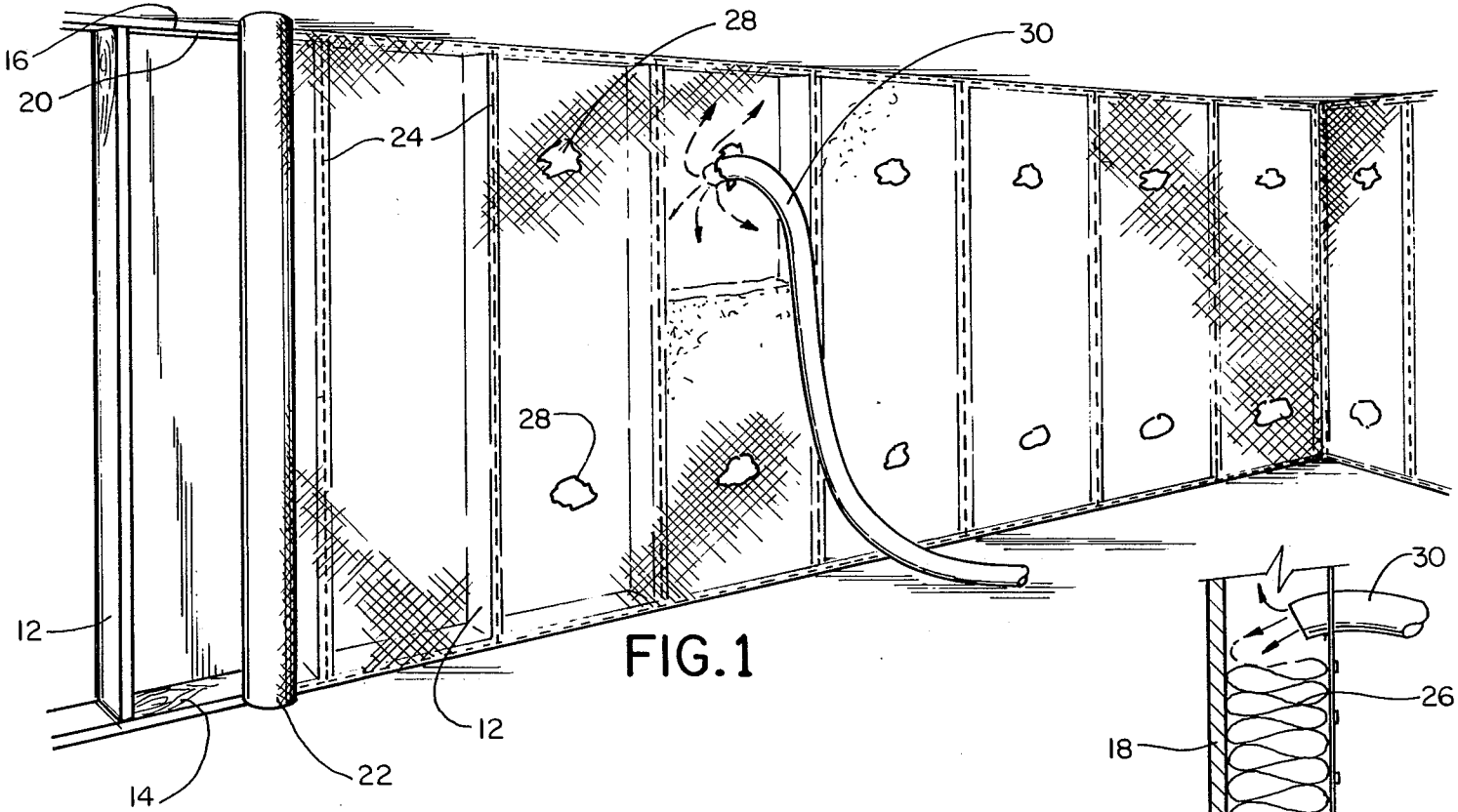
FIG. 1 is a perspective view of a structure illustrating the present invention.
Figure 2:
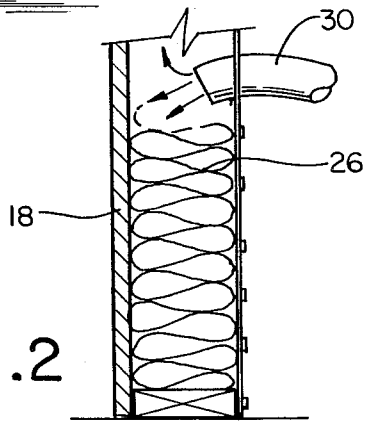
FIG. 2 is a side view of the structure shown in FIG. 1.

With reference to FIG. 1, the support skeleton for the inner walls of a building structure includes a number of vertically extending studs 12 mounted between lower joists 14 and upper joists 16. The studs 12 are typically spaced uniformly from one another. An outer wall 18, shown in FIG. 2, is mounted to or abuts the outwardly facing sides of studs 12, lower joists 14 and upper joists 16. Accordingly, a number of wall spaces 20 opening towards the interior are formed between each adjoining pair of studs 12.

Once the outer wall 18 has been installed, it is desirable to place insulation in the wall spaces 20 before an inner wall is installed so that there is no need to later remove part of the inner wall to gain access to wall spaces 20. If the insulation choice is loose fill or particulate insulation, an appropriate apparatus is required to retain the particulate insulation in wall spaces 20. In accordance with the present invention, netting 22 is provided to retain the particulate insulation. The netting 22 is secured to the inwardly facing sides of the studs 12, lower joists 14 and upper joists 16 by securing pieces 24. Particulate or loose fill insulation 26 is inserted into spaces 20 through one or more access holes 28 formed in the netting 22. To insert the particulate insulatoin 26, a hose 30 is selectively inserted in the access holes 28. The hose 30 is connected to a source of insulation and preferably has a nozzle connected at its exit end to facilitate the injection of the particulate insulation 26 into the wall spaces 20.

Figure 3:
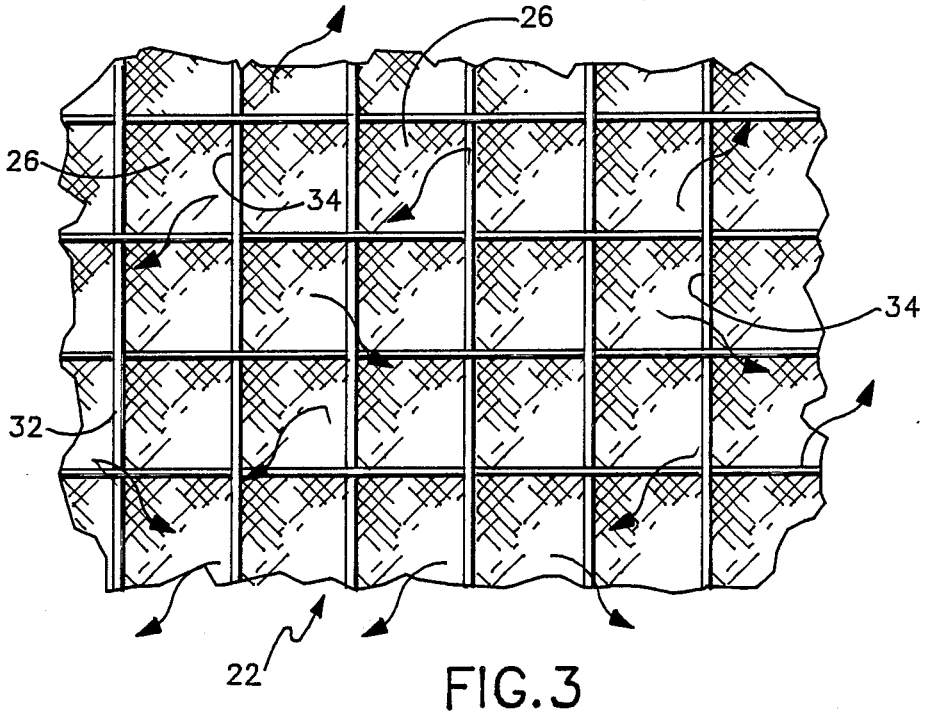
FIG. 3 is an enlarged view of the netting illustrating the greater area occupied by the netting holes.

The netting 22 is preferably provided in the form of a large cylindrical-shaped roll that includes overlapping strips of netting material which define equally sized netting holes 34, as best seen in FIG. 3. The netting 22 is so constructed as to provide a large number of netting holes 34, but which holes are sufficiently small to prevent spillage of the blown in insulation. The netting holes 34 serve an important function during the insertion of the particulate insulation 26 by allowing the escape of air which is displaced by the inserted insulation particles. The maximum insulating effect with blown-in insulation occurs when the particles are neither so loosely compacted as to cause the surrounding air space to dissipate the heat retention effect nor so tightly compacted that there is no supplemental insulating effect created by the air surrounding the particles. By allowing displaced air to escape, the netting holes 34 help the particulate insulation 26 to compact and achieve a desirable insulating capacity.

Figure 4:
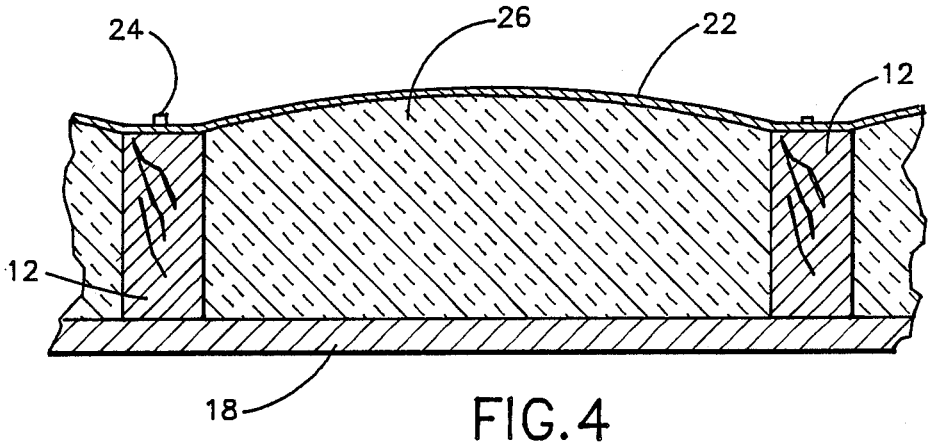
FIG. 4 is an enlarged view of the netting containing insulation illustrating the bowed-out state thereof.

The apparatus of the present invention also provides an indication or signal that a sufficient amount of insulation 26 has been "blown" into the portion of the enclosed space 20 which underlies the access hole 28. Specifically, as illustrated in FIG. 4, the netting 22 is adapted to bulge or bow out slightly away from the inside section of the structure when a sufficient density of insulation 26 has accummulated in the portion of an enclosed space adjacent to an access hole. To provide this desirable indicator function, the netting material and the size of the strips should be selected to provide netting 22 with resiliency to retain the blown in insulation 26 as well as flexibility to permit the netting to bulge slightly when an adequate amount of insulation has been inserted.

In order to install the insulation, the netting 22 is unrolled or unfolded over studs 12 and secured to the studs by the securing pieces 24, which can be nails, staples or other appropriate fasteners. Also, the top and bottom of each section of the netting 22 are secured to upper joists 16 and lower joists 14, respectively. Consequently, each enclosed space 20 is bounded on all sides, either by outer wall 18, studs 12, lower joists 14, upper joists 16 or netting 22, so that the injected particulate insulation 26 can be retained within each enclosed space 20.

After the netting 22 has been secured across studs 12, access holes 28 are created so as to give access to any particular enclosed space 20. In a preferred arrangement, each hole 28 is located equidistant two adjacent studs 12 to facilitate access to all portions of that part of enclosed space 20 which lies adjacent to the access hole 28. Each hole 28 can be created by widening one of the netting holes 34 or by cutting or tearing the netting material at the time the insulation 26 is to be fed to the wall spaces 20.

The hose 30 is then inserted into an access hole 28 and the particulate insulation 26 is "blown" into the encloded space 20. A preferred nozzle and process for supplying the insulation are described in U.S. Pat. No. 4,487,365 to Sperber, issued Dec. 11, 1984 and entitled "Reduced Fiber Insulation Nozzle." While the insulation 26 is being blown in, the newly inserted insulation displaces air in the enclosed space 20. The displaced air is propelled outward through the netting holes 34 and towards the interior of the building structure. Typically, not all of the enclosed air is displaced, however, and the remaining air combines with the particulate insulaton 26 to provide an effective insulating barrier.

When an adequate amount of particulate insulation 26 has been inserted below an access hole 28, the netting 22 bulges or bows out slightly (about 0.5–1 inch) to indicate to the user that the hose 30 should be withdrawn and moved to another access hole. The bulging or bowing effect need only be slight and will not later hinder the installation of the inner wall onto studs 12. As also can be seen in FIG. 1, the access holes 28 need not be covered after the insulation is in place thereby resulting in a further time savings for the installer. Additionally, the netting need not be heated or modified in any way to properly maintain the fed insulation in the wall spaces 20 thereby reducing the installation time.

Although the present invention has been described with reference to a particular embodiment, it should be appreciated that variations and modifications can be effected within the spirit and scope of this invention.

What is claimed is:

1. A method for placing loose fill insulation in a support frame of a building, comprising:

forming a support frame;

providing a netting from material having a predetermined degree of flexibility and netting holes;

attaching said netting to said support frame;

forming at least a first access hole in said netting;

feeding loose fill insulation between said netting and a portion of said support frame using said first access hole wherein said netting bulges out when sufficient loose fill insulation has been received;

observing said bulging out of said flexible netting as a signal that a sufficient amount of insulation has been fed between said netting and said portion of said support frame; and discontinuing said feeding of said insulation.

2. A method, as claimed in claim 1, further including:

keeping said first opening in said netting after said insulation is fed between said portion of said support frame and said netting.

3. A method, as claimed in claim 1, wherein:

said step of forming a support frame includes providing a vertically-extending wall frame having a pair of vertically-extending studs and said step of forming a first access hole includes forming said first access hole in portions of said netting located between said pair of studs and said method further includes forming a second access hole, said second access hole also being located in a portion of said netting between said same pair of studs.

4. A method, as claimed in claim 1, further including:

maintaining said insulation between portions of said support frame and said netting in the absence of heat being applied to said netting.

5. A method, as claimed in claim 1, wherein:

said step of feeding loose fill insulation comprises positioning the opened end of an insulation-blowing hose through said first access hole.

6. A method, as claimed in claim 1, wherein:

said step of forming a support frame comprises forming a support frame between a floor and a ceiling; and said step of attaching said netting comprises extending said netting throughout the entire space between said floor and said ceiling.

7. A method, as claimed in claim 1, wherein:

said step of feeding loose fill insulation comprises inserting a first length of insulation-blowing hose through said first access hole; and maintaining said length of hose positioned through said access hole continuously until said discontinuing step.

8. A method, as claimed in claim 1, wherein:

said step of feeding loose fill insulation comprises inserting a portion of an insulation-blowing hose through said first access hole; and using said hose to blow insulation upward with respect to said access hole.

9. A method, as claimed in claim 1, further comprising:

attaching inner wall material to said support frame wherein said netting is positioned between said inner wall material and at least a portion of said support frame.

10. An apparatus for providing insulation in a building, comprising:

a support frame;

netting means connected to said support frame, said netting means including netting material and netting holes, said netting holes being of a sufficient size to permit escape of air, at least a first access hole also being provided in said netting means;

loose fill insulation means located between said netting means and at least portions of said support frame, said insulation means occupying space previously occupied by air escaping through said netting holes when said insulation means is placed between said netting means and said portions of said support frame; and said netting means having a selected degree of flexibility whereby when sufficient loose fill insulation means has been received in said space, said netting means provides a signal thereof by bulging out.

11. An apparatus, as claimed in claim 10, wherein:

said support frame includes a vertically-standing wall frame.

12. An apparatus, as claimed in claim 11, wherein:

said wall frame includes at least a pair of spaced studs, at least two access holes being formed in said netting means located between said pair of spaced studs with said two access holes remaining uncovered after said insulation means is located within said pair of studs and said netting means.

13. An apparatus, as claimed in claim 10, further comprising:

inner wall material attached to said support frame wherein said netting means is positioned between said inner wall material and at least a portion of said support frame.

14. An apparatus, as claimed in claim 10, wherein:

at least portions of said netting means bulges out at least about 0.5 inch to indicate that sufficient insulation was provided.

15. An apparatus for providing insulation in a building, comprising:

a support frame having upper and lower portions;

air permeable means connected to said support frame and extending between said upper and lower portions thereof, said air permeable means having sufficient permeability to permit the escape of air;

loose fill insulation means located between said air permeable means and at least portions of said support frame, said insulation means occupying space previously occupied by air escaping through said air permeable means when said insulation means is located between said air permeable means and said portions of said support frame; and said air permeable means having a selected degree of flexibility whereby when sufficient loose fill insulation means has been received in said space, said air permeable means provides a signal thereof by bulging out.

* * * * *